US008662318B1

(12) United States Patent
Caporale-Colon

(10) Patent No.: US 8,662,318 B1
(45) Date of Patent: Mar. 4, 2014

(54) APPARATUS FOR CARRYING AND STORING FOOTWEAR

(71) Applicant: Donna Caporale-Colon, New Haven, CT (US)

(72) Inventor: Donna Caporale-Colon, New Haven, CT (US)

( * ) Notice: Subject to any disclaimer, the term of this patent is extended or adjusted under 35 U.S.C. 154(b) by 0 days.

(21) Appl. No.: 13/658,802

(22) Filed: Oct. 23, 2012

(51) Int. Cl.

| | |
|---|---|
| ***A47F 7/08*** | (2006.01) |
| ***A44B 6/00*** | (2006.01) |
| ***A45F 5/00*** | (2006.01) |
| ***A44B 1/04*** | (2006.01) |
| ***A44B 11/25*** | (2006.01) |
| ***A44B 15/00*** | (2006.01) |
| ***A44B 17/00*** | (2006.01) |

(52) U.S. Cl.
USPC ..... 211/34; 24/3.13; 24/302

(58) Field of Classification Search
USPC ..... 211/34, 85.3, 113; 24/302, 301, 482; 224/255
See application file for complete search history.

(56) References Cited

U.S. PATENT DOCUMENTS

| | | | | | |
|---|---|---|---|---|---|
| 4,096,977 | A | * | 6/1978 | Barville et al. | 224/148.6 |
| 4,420,104 | A | * | 12/1983 | DiIenno | 224/250 |
| 4,483,470 | A | | 11/1984 | Cousins | |
| 4,877,163 | A | * | 10/1989 | Zimmerman | 223/93 |
| 5,104,076 | A | * | 4/1992 | Goodall, Jr. | 248/205.2 |
| 5,174,483 | A | * | 12/1992 | Moore et al. | 224/250 |
| 5,265,834 | A | * | 11/1993 | Daniels | 248/104 |
| 5,535,928 | A | * | 7/1996 | Herring | 224/250 |
| 5,582,337 | A | | 12/1996 | McPherson | |
| 5,642,842 | A | | 7/1997 | Taras | |
| 5,690,261 | A | | 11/1997 | Moore | |
| 5,806,730 | A | * | 9/1998 | Deno | 224/148.6 |
| 5,975,392 | A | * | 11/1999 | Miller et al. | 224/651 |
| 6,000,591 | A | * | 12/1999 | Alexander | 224/257 |
| 6,318,612 | B1 | * | 11/2001 | MacNeil | 224/572 |
| 8,177,075 | B2 | * | 5/2012 | Hathorn | 211/34 |
| 2002/0030071 | A1 | * | 3/2002 | Griffiths | 224/251 |
| 2009/0000083 | A1 | * | 1/2009 | Richard et al. | 24/302 |
| 2009/0071917 | A1 | | 3/2009 | Hathorn | |
| 2010/0252592 | A1 | | 10/2010 | McKinney et al. | |
| 2013/0015226 | A1 | * | 1/2013 | Goodwin | 224/607 |

* cited by examiner

*Primary Examiner* — Darnell Jayne
*Assistant Examiner* — Kimberley S Wright
(74) *Attorney, Agent, or Firm* — Raymond A. Nuzzo

(57) ABSTRACT

An apparatus for carrying and storing footwear has a flexible, substantially "T" shaped member having a first section and a second section that is transverse to the first section. The second section extends in opposite directions to first and second distal ends. The "T" shaped member has front and rear sides, wherein fastening devices are attached to the front side and mating fastening devices are attached to the rear side. Each fastening device on the front side is configured to be removably attached to a corresponding mating fastener on the rear side. Fastening devices on the front side are located on the first section adjacent the second section and on the second section adjacent the first distal end. Mating fastening devices on the rear side are located on the first section adjacent the distal end of the first section and on the second section adjacent the second distal end.

15 Claims, 8 Drawing Sheets

APPARATUS FOR CARRYING AND STORING FOOTWEAR

STATEMENT OF GOVERNMENT INTEREST

None.

CROSS REFERENCE TO OTHER PATENT APPLICATIONS

None.

BACKGROUND OF THE INVENTION (1) Field of the Invention

The present invention relates to an apparatus for carrying and storing footwear or other objects.

(2) Description of the Prior Art

Devices for carrying and storing footwear and ice skates are disclosed in U.S. Pat. Nos. 4,483,470, 5,582,337, 5,642,842, 5,690,261, and in U.S. Patent Application Publication Nos. US2009/0071917 and US2010/0252592.

SUMMARY OF THE INVENTION

The present invention is directed to an apparatus for carrying and storing footwear. In one embodiment, the apparatus comprises a flexible, substantially "T" shaped member comprising a first section having a longitudinally extending axis and which extends to a distal end, and a second section that is transverse to the first section. The flexible, substantially "T" shaped member has a front side and a rear side. The second section comprises a first portion that is orthogonal to the longitudinally extending axis and extends to a first distal end in a first direction. The second section also has a second portion that is orthogonal to the longitudinally extending axis and extends to a second distal end in a second direction that is opposite to the first direction. The apparatus further comprises a plurality of fastening devices on the front side of the substantially "T" shaped member, wherein at least one fastening device is located on the first section adjacent to the second section and at least one fastening device is on the first portion of the second section adjacent the first distal end. The apparatus further comprises a plurality of mating fastening devices on the rear side of the substantially "T" shaped member, wherein each of the fastening devices on the front side are configured to be removably connected to a corresponding mating fastener on the rear side. At least one of the mating fastening devices is on the first section adjacent the distal end of the first section. At least one mating fastening device is on the second portion of the second section adjacent the second distal end. The first and second portions of the second section each have a length that is sufficient to allow the first and second portions to be inserted through an object and then attached together with the fastening device on the first portion of the second section and the mating fastening device on the second portion of the second section. In a preferred embodiment, the apparatus includes means for removably attaching a decorative item to the substantially "T" shaped member.

In another aspect, the present invention is directed to an apparatus for carrying and storing footwear comprising a flexible, substantially "T" shaped member comprising a first section that has a longitudinally extending axis and which extends to a distal end, and a second section that is transverse to the first section. The second section comprises a first portion that extends in a first direction to a first distal end and a second portion that extends in an opposite, second direction to a second distal end. The flexible, substantially "T" shaped member has a front side and a rear side. A plurality of fastening devices are on the front side of the substantially "T" shaped member, wherein at least one fastening device is located on the first section adjacent to the second section and at least one fastening device is on the first portion of the second section adjacent the first distal end of the first portion. The apparatus further comprises a plurality of mating fastening devices on the rear side of the substantially "T" shaped member. Each of the fastening devices on the front side are configured to be removably attached to a corresponding mating fastener on the rear side. At least one of the mating fastening devices is on the first section adjacent the distal end of the first section, and at least one mating fastening device is on the second portion of the second section adjacent the second distal end of the second portion. The first and second portions of the second section each have a length that is sufficient to allow the first portion and the second portion to be inserted through an object and then attached together with the fastening device on the first portion and the mating fastening device on the second portion so as to form a first closed loop. The first section forms a second closed loop when the mating fastening device on the rear side of the first section is connected to the fastening device on the front side of the first section.

Other embodiments of the invention are described in the ensuing description.

DETAILED DESCRIPTION OF THE INVENTION

Figure 2:
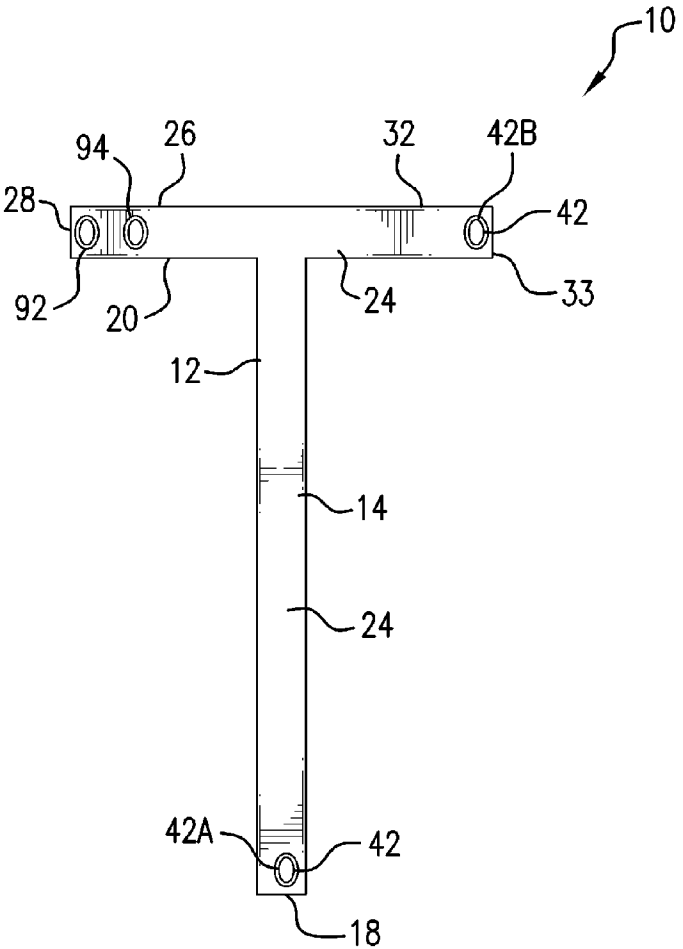
FIG. 2 is an elevational view of the rear side of the apparatus of FIG. 1.
Figure 1:
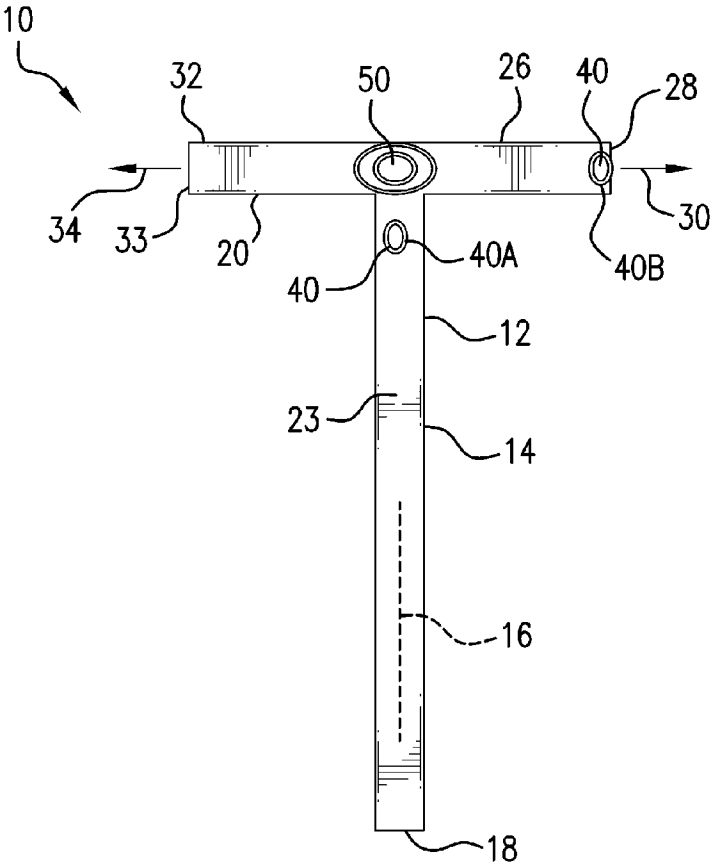
FIG. 1 is an elevational view of the front side of an apparatus for carrying and storing footwear and other items, the view showing the apparatus in an unfastened state.

Referring to FIGS. 1 and 2, there is shown apparatus 10 for carrying and storing footwear and other objects in accordance with one embodiment of the present invention. Apparatus 10 comprises flexible, substantially "T" shaped member 12. Member 12 comprises first section 14 which has longitudinally extending axis 16. First section 14 extends to distal end 18. Member 12 further comprises second section 20 that is transverse to first section 14. Flexible, substantially "T" shaped member 12 has front side 23 and rear side 24.

Referring to FIGS. 1 and 2, second section 20 comprises first portion 26 that is orthogonal to longitudinally extending axis 16 and extends in direction 30 to first distal end 28. Second section 20 also has a second portion 32 that is orthogonal to longitudinally extending axis 16 and extends in opposite direction 34 to second distal end 33.

Apparatus 10 further comprises a plurality of fastening devices 40 on front side 23 of substantially "T" shaped member 12. At least one fastening device 40 is located on first section 14 adjacent to second section 20 and at least one fastening device 40 is on first portion 26 and adjacent to first distal end 28. Apparatus 10 further comprises a plurality of mating fastening devices 42 on rear side 24 of substantially "T" shaped member 12. Each fastening device 40 on front side 23 is configured to be removably connected to a corresponding mating fastening device 42 on rear side 24. At least one mating fastening device 42 is on first section 14 adjacent to distal end 18. At least one mating fastening device 42 is on second portion 32 and adjacent to second distal end 33. In order to configure apparatus 10 in a completely fastened state, a user will connect mating fastening device 42B to fastening device 40B, and will connect mating fastening device 42A to fastening device 40A. FIG. 3C shows apparatus 10 in a completely fastened state. If a user desires to configure apparatus 10 in only a partially fastened state, then the user would only connect mating fastening device 42B to fastening device 40B, and would not connect mating fastening device 42A to fastening device 40A so as to leave section 14 hanging downward (see FIG. 5).

In a preferred embodiment, substantially "T" shaped member 12 is fabricated from materials chosen from the group comprising silicone, silicone rubber, leather, synthetic leather, plastic, resin, denim fabric, and expanded polytetrafluoroethylene (ePTFE) which is marketed under the federally registered trademark GORE-TEX®. Other suitable fabrics may be used as well.

In a preferred embodiment, the material from which substantially "T" shaped member 12 is fabricated is a pliable material.

In a preferred embodiment, the substantially "T" shaped member 12 is fabricated from eco-friendly materials.

In a preferred embodiment, substantially "T" shaped member 12 has a degree of elasticity.

In a preferred embodiment, the material from which substantially "T" shaped member 12 is fabricated is waterproof.

Each of the fastening devices 40 and mating fastening devices 42 may be configured as any suitable commercially available fastening device such as metal snaps, plastic snaps, hooks, slide clasps, interlocking clasps and magnets. If magnets are used, then each fastening device 40 is configured as a magnet, and each mating fastening device 42 is configured as a piece of magnetic material such as iron or other suitable magnetic material. Each of the fastening devices 40 and mating fastening devices 42 may also be configured as fabric hook-and-loop fasteners which are marketed under the trademark VELCRO®.

In one embodiment, each fastening device 40 comprises a male snap, and each of the plurality of mating fastening devices 42 comprises a complementary mating, female snap.

In an alternate embodiment, apparatus 10 includes more than one fastening device 40A on front side 23 of section 14. In such an embodiment, the fastening devices 40A are positioned in a linear arrangement along longitudinally extending axis 16.

In an alternate embodiment, apparatus 10 includes more than one mating fastening device 42A attached to rear side 24 of section 14. In such an embodiment, mating fastening devices 42A are positioned in a linear arrangement along longitudinally extending axis 16.

In an alternate embodiment, apparatus 10 includes more than one fastening device 40B attached to front side 23 of portion 26. In such an embodiment, mating fastening devices 40B are positioned in a linear arrangement.

In an alternate embodiment, apparatus 10 includes more than one mating fastening device 42B on the rear side 24 of portion 32. In such an embodiment, mating fastening devices 42B are positioned in a linear arrangement.

Figure 3A:
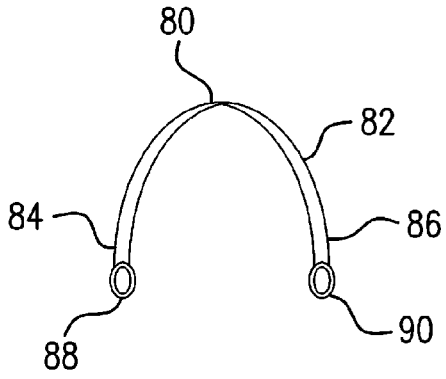
FIG. 3A is an elevational view of a device that configured to be removably attached to the apparatus of FIG. 1 for hanging the apparatus on a hook or similar article.
Figure 3C:
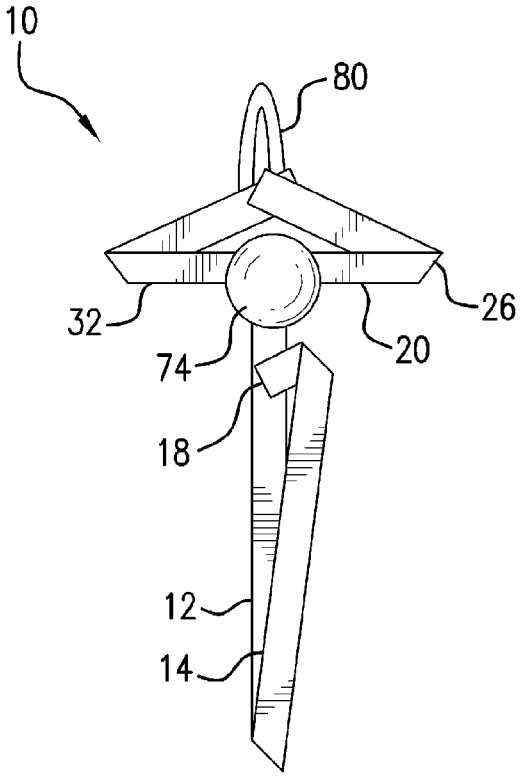
FIG. 3C is a perspective view of the apparatus of FIG. 1 having attached thereto the device of FIG. 3A, the view showing the apparatus in a completely fastened state.
Figure 4A:
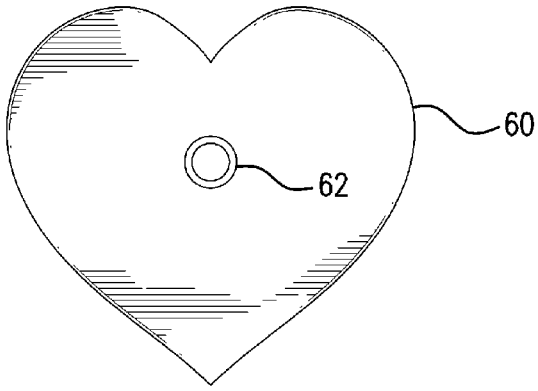
FIG. 4A is a view of a rear side of a decorative item that can be removably attached to the apparatus of FIG. 1.
Figure 4C:
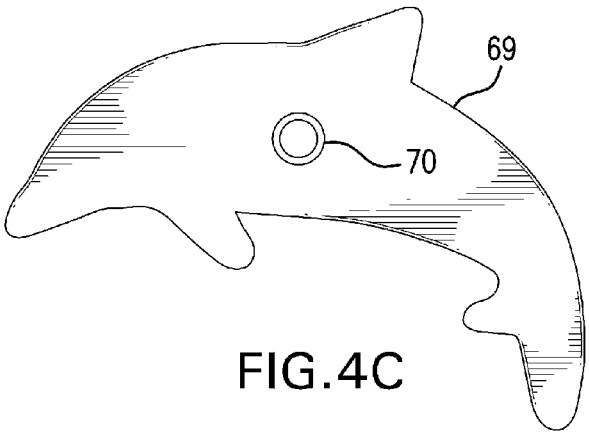
FIG. 4C is a view of the rear side of another decorative item that can be removably attached to the apparatus of FIG. 1.
Figure 4D:
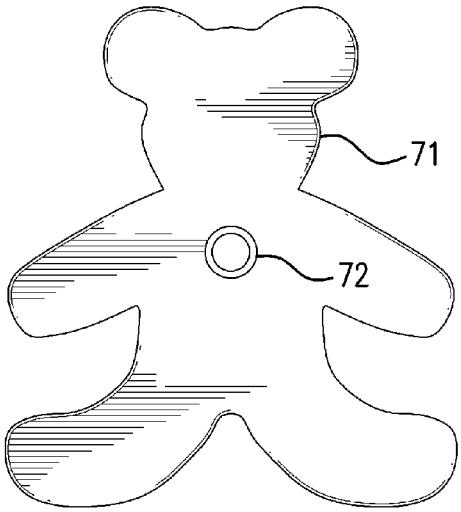
FIG. 4D is a view of the rear side of yet another decorative item that can be removably attached to the apparatus of FIG. 1.
Figure 4B:
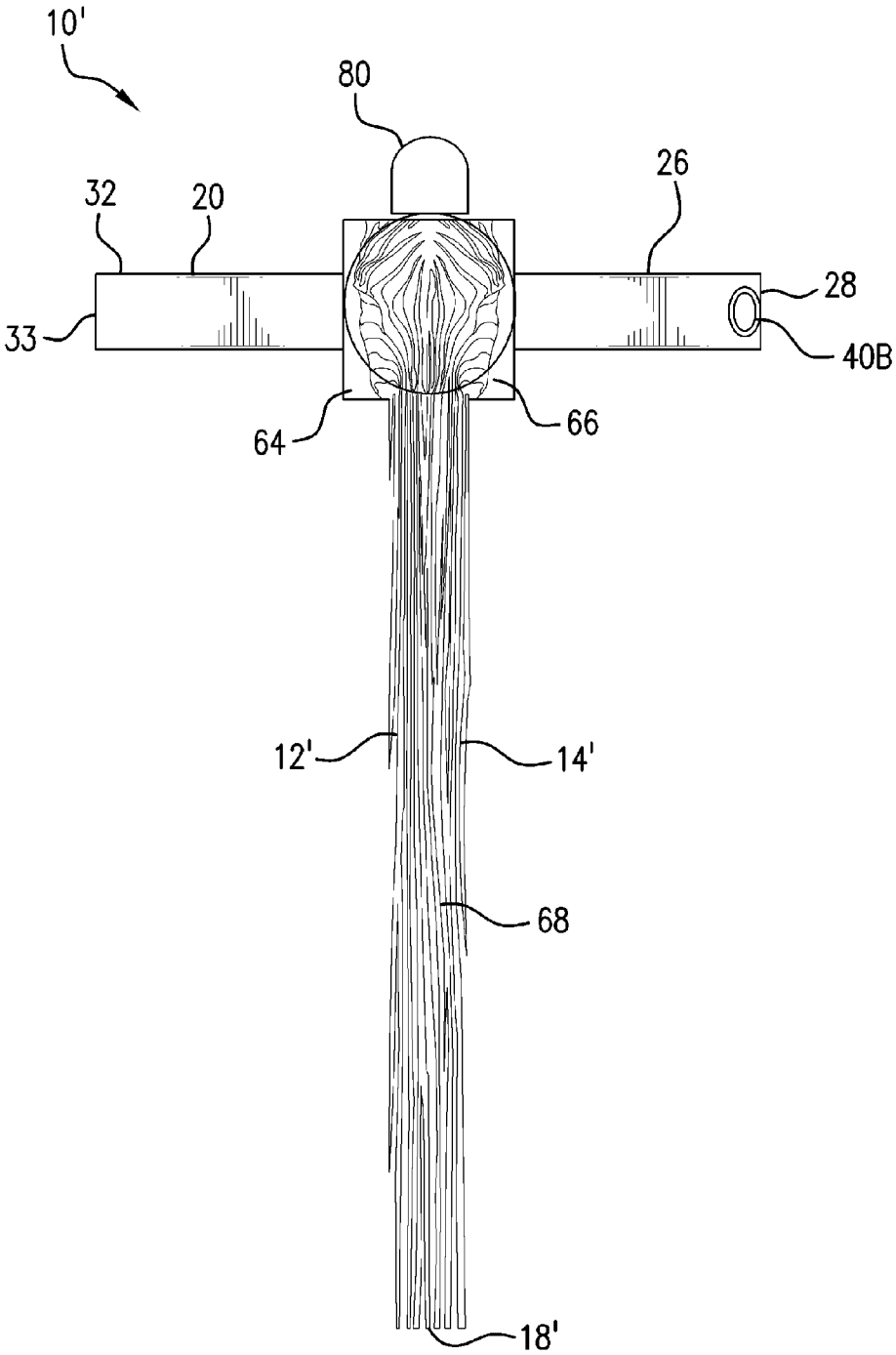
FIG. 4B is an elevational view showing a decorative item removably attached to the apparatus of FIG. 1, the view showing the apparatus in the unfastened state.

Referring to FIGS. 1, 3C, 4A and 4B, apparatus 10 is configured so that any one of a variety of decorative items and pieces can be removably attached to substantially "T" shaped member 12. In order to achieve this object, apparatus 10 includes fastening device 50 on section 20. In a preferred embodiment, fastening device 50 is located at or in proximity to the center region of second section 20. Fastening device 50 is configured to be removably connected to a mating fastening device that is part of a decorative item or piece. This allows the decorative item or piece to be removably attached to substantially "T" shaped member 12. For example, referring to FIG. 4A, there is shown a rear side of a decorative item 60 in the shape of heart. Decorative item 60 includes mating fastening device 62 which is configured to be removably connected to fastening device 50. Referring to FIG. 4B, there is shown apparatus 10' in accordance with another embodiment of the invention. Apparatus 10' comprises a substantially "T" shaped member 12' which comprises first section 14' and second section 20. Section 20 was previously shown in FIGS. 1 and 2. First section 14' includes distal end 18'. First section 14' is a modified version of first section 14 which is shown in FIGS. 1 and 2. Specifically, first section 14' has decorative surface and contour 68 whereas first section 14, shown in FIGS. 1 and 2, has a substantially flat surface. Decorative item 64 is removably attached to substantially "T" shaped member 12'. Decorative item 64 comprises a body member 66. A mating fastening device (not shown) is on the rear side (not shown) of body member 66 and is removably connected to fastening device 50. FIGS. 4C and 4D show other examples of decorative items that can be removably attached to apparatus 10. FIG. 4C shows a decorative item 69 is in the shape of a dolphin. Decorative item 69 includes mating fastening device 70 which is configured to be removably connected to fastening device 50. FIG. 4D shows decorative item 71 that is in the shape of a bear. Decorative item 71 includes mating fastening device 72 which is configured to be removably connected to fastening device 50. Referring to FIG. 3C, decorative item 74 is removably attached to apparatus 10 and has an ornamental design that simulates a piece of jewelry. It is to be understood that the decorative items that can be removably attached to substantially "T" shaped member 12 can be of any ornamental design, and that the decorative items 60, 64, 69, 71 and 74 are just examples. In one embodiment, decorative items are magnetically attached to substantially "T" shaped member 12. In such an embodiment, fastening device 50 is configured as a magnet and a piece of magnetic material is attached to the rear side of the decorative item.

Figure 3B:
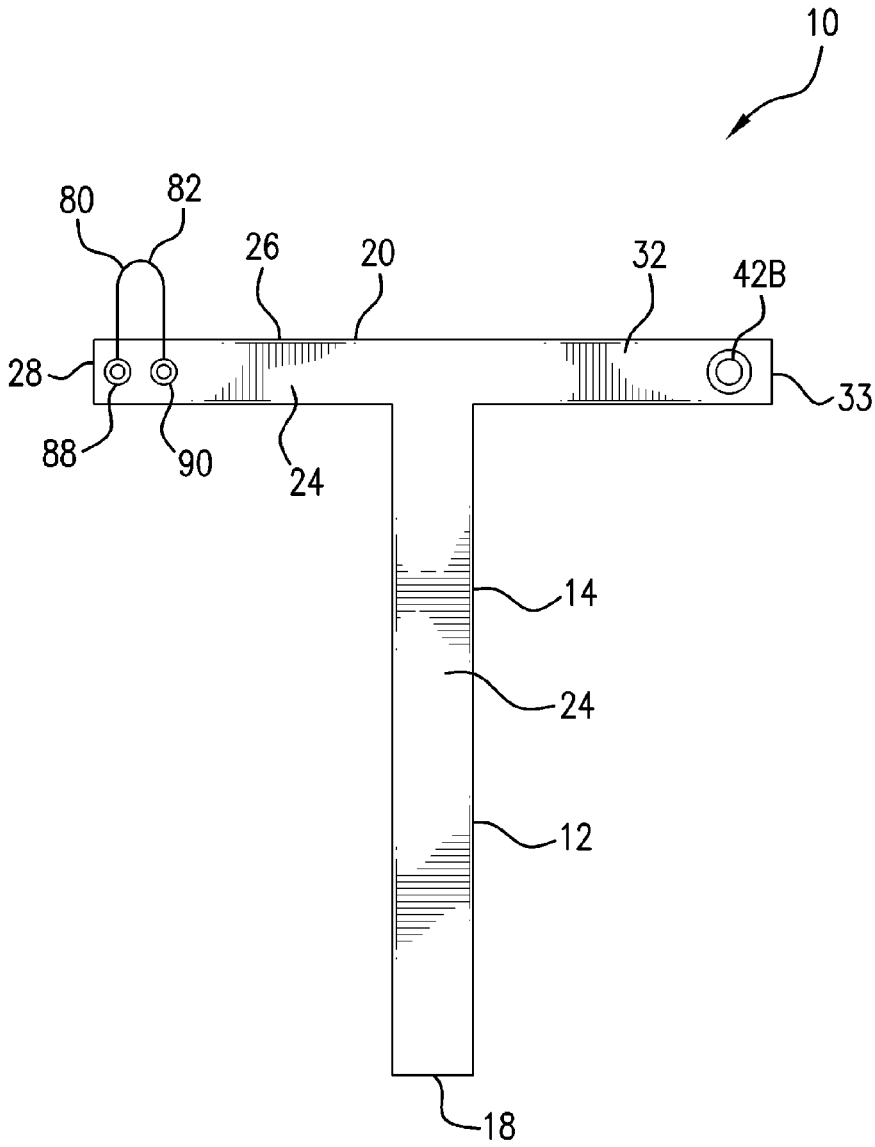
FIG. 3B is an elevational view of the rear side of the apparatus of FIG. 1, the view showing the device of FIG. 3A attached to the rear side of the apparatus.

Referring to FIGS. 3A, 3B and 3C, apparatus 10 further comprises device 80 that is removably attached to substantially "T" shaped member 12 for securing or hanging apparatus 10 on a hook, nail or other similar object. In one embodiment, device 80 comprises a generally "U" shaped member 82 having a pair of ends 84 and 86. Device 80 includes a pair of fastening devices 88 and 90 that are attached to ends 84 and 86, respectively. Fastening devices 88 and 90 are configured to be removably attached to corresponding mating fasteners 92 and 94, respectively, on rear side 24 of section 20 (see FIGS. 2 and 3B). In an alternate embodiment, device 80 is removably attached to a different location on second section 20 using fastening devices and corresponding mating fastening devices. Device 80 has a size and shape that allows it to be secured to a clothes closet hanger bar or other similar structure. In order to secure device 80 to the clothes closet hanger bar, the user detaches or unfastens either fastening device 88 or 90 from its corresponding mating fastening device 92 or 94, respectively. The open end of device 80 is then wrapped or looped over the hanger bar and then refastened to its corresponding mating fastening device 92 or 94. In a preferred embodiment, device 80 is made from flexible material, such a plastic, metal wire, rubber, strong fabric, etc.

In an alternate embodiment, a hook is used in place of device 80. In such an alternate embodiment, the hook has a fastening device that is configured to be removably connected to a corresponding mating fastening device on second section 20. The hook has a size and shape that allows it to be secured to a clothes closet hanger bar or other similar structure.

Figure 5:
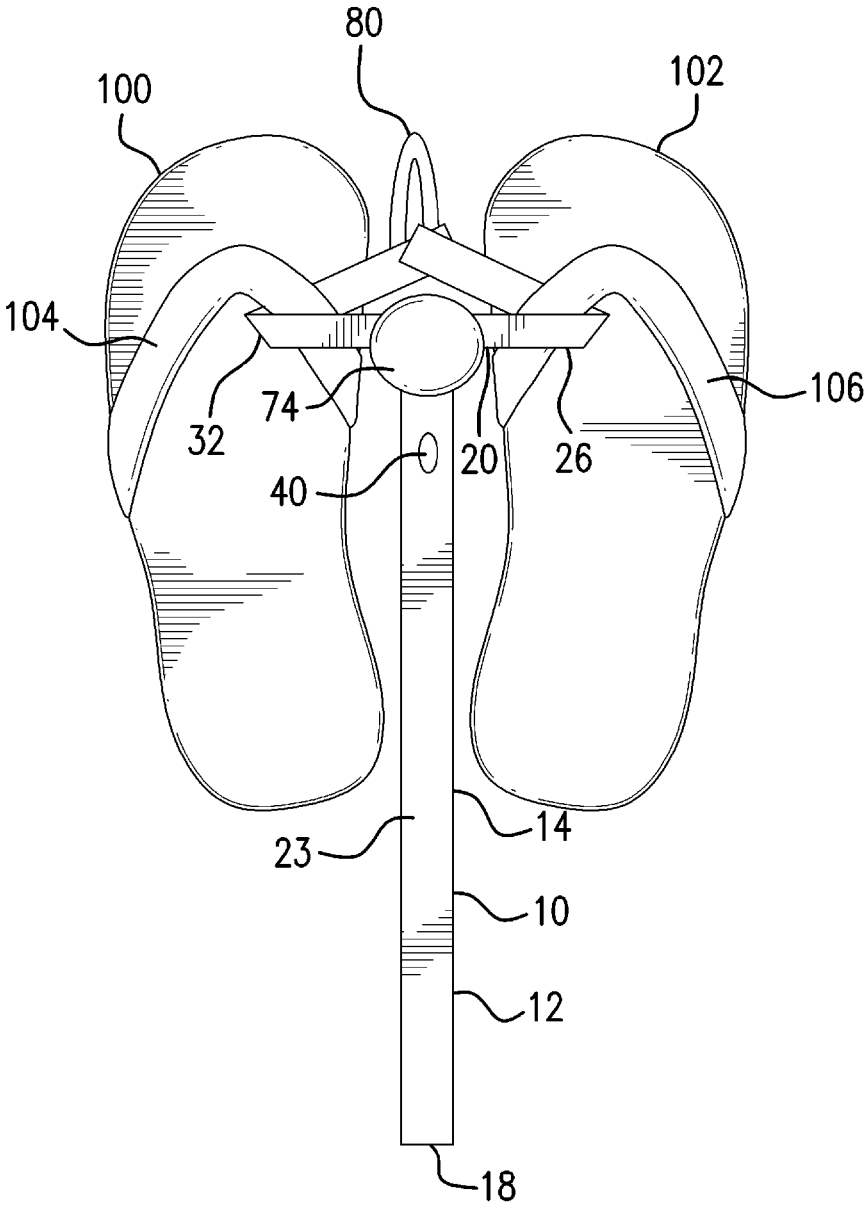
FIG. 5 is an elevational view of the apparatus of FIG. 1 configured in a partially fastened state to hold a pair of sandals.

Referring to FIGS. 1, 2 and 5, first portion 26 and second portion 32 each have a length that is sufficient to allow first and second portion 26 and 32, respectively, to be inserted through a pair of footwear (e.g. pair of sandals) or some other object and then attached together with fastening device 40B on first portion 26 of second section 20 and mating fastening device 42B on second portion 32 of second section 20. This is illustrated in FIG. 5 wherein apparatus 10 secures a pair of sandals 100 and 102 together. Sandal 100 has top strap 104. Similarly, sandal 102 has top strap 106. The user inserts portion 32 of section 20 under strap 104 of sandal 100. Similarly, the user inserts portion 26 of section 20 under strap 106. Portions 26 and 32 are attached together using fastening device 40B and mating fastening device 42B.

Figure 6:
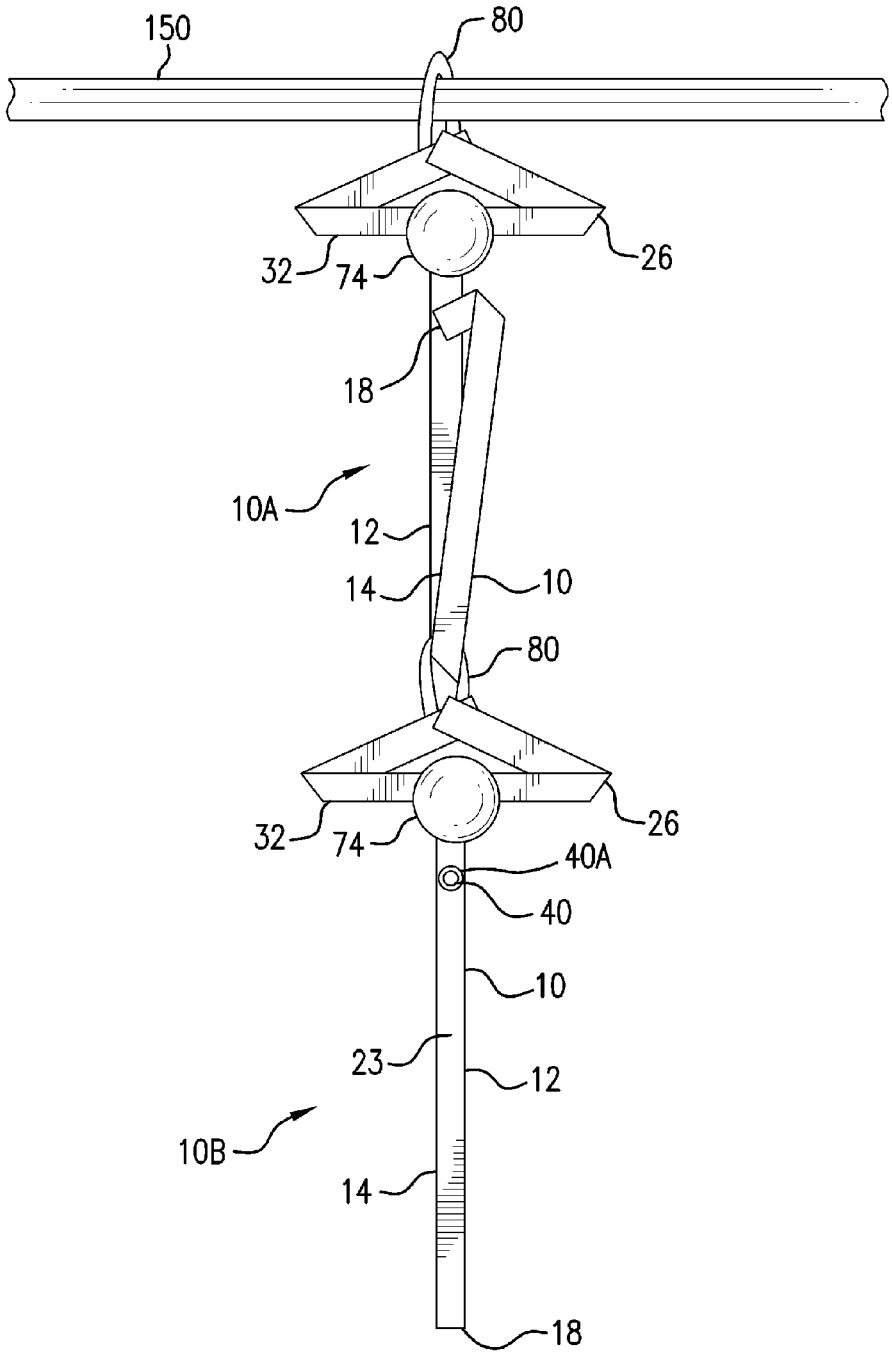
FIG. 6 is an elevational view showing two of the apparatuses of FIG. 1 in a daisy-chain configuration, wherein the uppermost apparatus is in a completely fastened state and the lower most apparatus is in a partially fastened state.

Referring to FIG. 6, there is shown a pair of apparatuses 10 arranged in a daisy-chain configuration. The upper apparatus 10, also indicated by reference number 10A, is secured to a clothes closet hanger bar 150 by device 80. Portions 26 and 32 are attached together to form a first closed loop. Section 14 forms a second closed loop when mating fastening device 42A is attached to fastening device 40A. When apparatus 10 is manipulated by the user to form both first and second closed loops, then apparatus 10 is in the completely fastened state. Footwear (e.g. sandals) can be secured in the first closed loop formed by portions 26 and 32 (see FIG. 5), or the footwear can be secured in the loop formed by section 14. Device 80 of the lower apparatus 10, also indicated by reference number 10B, is secured to the loop formed by section 14 of the upper apparatus 10A. Lower apparatus 10B is not in the completely fastened state and thus, section 14 of the lower apparatus 10B hangs downward. If a user desires to attach an additional apparatus 10 to the daisy-chain, the user must form a closed loop with section 14 of the lower apparatus 10B by attaching the mating fastening device 42A to the corresponding fastening device 40A. Next, the user may secure device 80 of the third apparatus 10 to the closed loop formed by section 14 of the apparatus 10B. Thus, a user can add as many apparatuses 10 to the daisy-chain as he or she desires.

Figure 7:
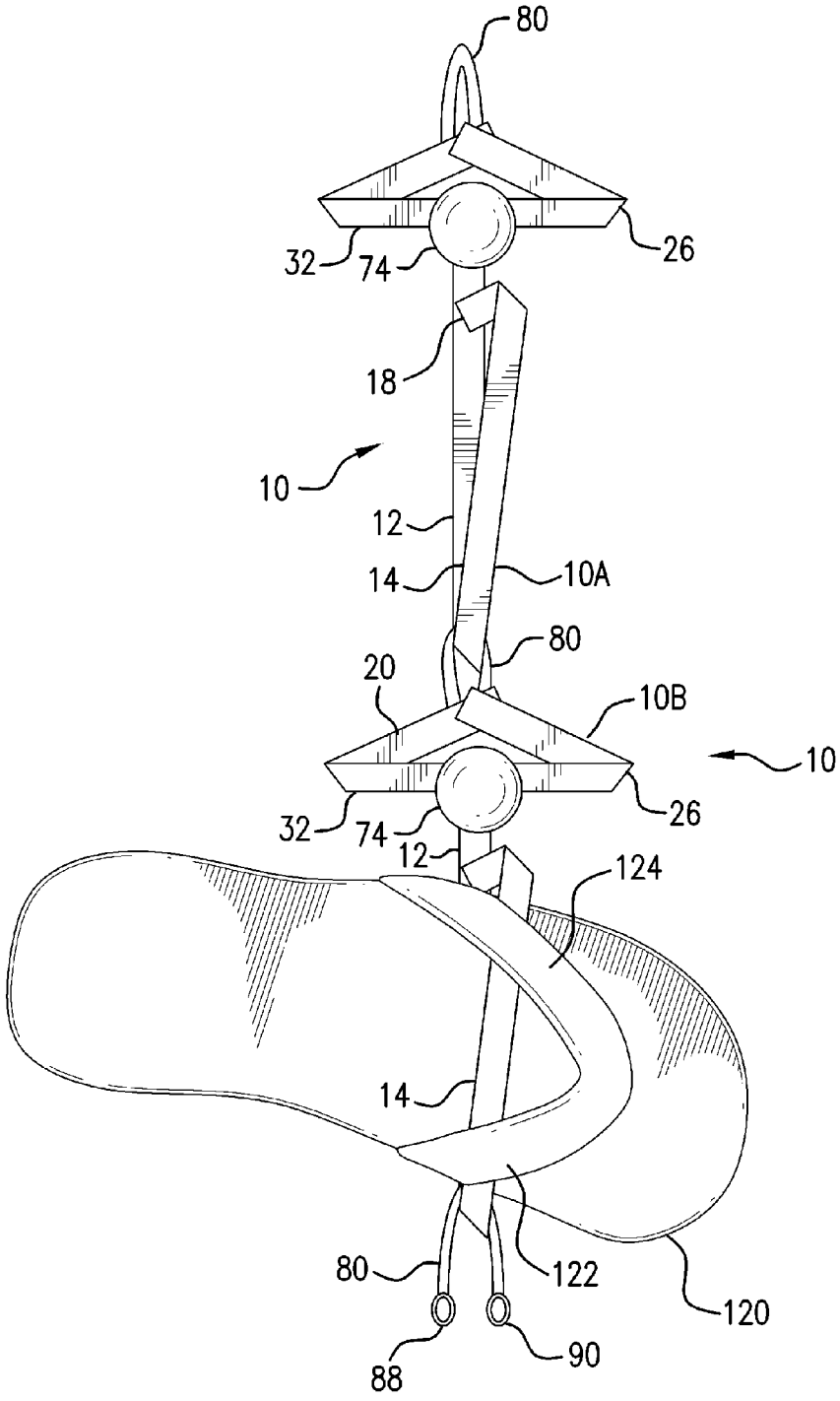
FIG. 7 is an elevational view showing two of the apparatuses of FIG. 1 in a daisy-chain configuration, wherein the uppermost apparatus is in a completely fastened state to support the lowermost apparatus and wherein the lowermost apparatus has a sandal secured thereto.

Referring to FIG. 7, both apparatuses 10A and 10B are completely fastened. Lower apparatus 10B is suspended from upper apparatus 10A. Sandal 120 is secured to lower apparatus 10B. Sandal 120 has straps 122 and 124. First section 14 is disposed under straps 122 and 124 and wrapped around the sole of sandal 120 so as to secure sandal 120 to apparatus 10B. Device 80 is suspended from the loop formed by fastened section 14 of lower apparatus 10B so that a third apparatus 10 can be removably secured to lower apparatus 10B.

The apparatus 10 of the present invention has many uses and applications. Apparatus 10 may be removably secured to a belt loop, back-pack, knap-sack, bicycle, etc. This can be accomplished by just inserting or wrapping portions 26 and 32 around the object (e.g. belt loop) and then attaching portions 26 and 32 together to form the closed loop. In the alternative, device 80 can be attached to apparatus 10 and then device 80 can then be removably secured or attached to almost any object, e.g. bicycle handle, belt loops, closet hanger, knap-sack, back-pack, any of the loops on a back-pack or knap-sack, nail, peg, clothes hook, clothes closet hanger bar, etc. Apparatus 10 may be used to carry or store other objects such as belts, keys, toys, jewelry, etc.

It will be understood that many additional changes in the details, materials, steps and arrangement of parts, which have been herein described and illustrated in order to explain the nature of the invention, may be made by those skilled in the art within the principle and scope of the invention as expressed in the appended claims.

The foregoing description of the preferred embodiments of the invention has been presented for purposes of illustration and description only. It is not intended to be exhaustive nor to limit the invention to the precise form disclosed; and obviously many modifications and variations are possible in light of the above teaching. Such modifications and variations that may be apparent to a person skilled in the art are intended to be included within the scope of this invention as defined by the accompanying claims.

What is claimed is:

1. An apparatus (10) for carrying and storing an object, comprising:

a flexible, substantially "T" shaped member (12) comprising a first section (14) that has a longitudinally extending axis (16) and which extends to a distal end (18), and a second section (20) that is transverse to the first section (14), the flexible, substantially "T" shaped member (12) having a front side (23) and a rear side (24), the second section (20) comprising a first portion (26) that is orthogonal to the longitudinally extending axis (16) and extends to a first distal end (28) in a first direction (30) and a second portion (32) that is orthogonal to the longitudinally extending axis (16) and extends to a second distal end (33) in a second direction (34) that is opposite to the first direction (30);

a plurality of fastening devices (40) on the front side (23) of the substantially "T" shaped member (12), wherein at least one fastening device (40, 40A) is located on the first section (14) adjacent to the second section (20) and at least one fastening device (40, 40B) is on the first portion (26) of the second section (20) adjacent the first distal end (28), the apparatus (10) further comprising a plurality of mating fastening devices (42) on the rear side (24) of the substantially "T" shaped member (12), wherein each of the fastening devices (40) on the front side (23) are configured to be removably attached to a corresponding mating fastener (42) on the rear side (24), wherein at least one of the mating fastening devices (42, 42A) is on the first section (14) adjacent the distal end (18) of the first section (14), and wherein at least one mating fastening device (42B) is on the second portion (32) of the second section (20) adjacent the second distal end (33); and wherein the first portion (26) and the second portion (32) each has a length that is sufficient to allow the first portion (26) and the second portion (32) to be inserted through an object and then attached together with the fastening device (40B) on the first portion (26) and the mating fastening device (42B) on the second portion (32).

2. The apparatus according to claim 1 further comprising means for removably attaching a decorative item (74) to the substantially "T" shaped member (12).

3. The apparatus according to claim 1 further comprising means for removably attaching a decorative item (74) to the front side (23) of the substantially "T" shaped member (12).

4. The apparatus according to claim 1 further comprising means for removably attaching a decorative item (74) to the front side (23) of the substantially "T" shaped member (12) so that the decorative item (74) is positioned on the second section (20).

5. The apparatus according to claim 1 further comprising means for magnetically attaching a decorative item (64) to the substantially "T" shaped member (12).

6. The apparatus according to claim 1 wherein each of the plurality of fastening devices (40) on the front side (23) comprises a male snap, and each of the plurality of mating fastening devices (42) on the rear side (24) comprises a mating, female snap.

7. The apparatus according to claim 1 further comprising a device (80) removably attached to the substantially "T" shaped member (12) for securing the apparatus (10) to an object or structure.

8. The apparatus according to claim 7 wherein the device (80) is a generally "U" shaped member having a pair of ends, wherein the ends of the generally "U" shaped member are removably attached to the second section (20).

9. The apparatus according to claim 8 wherein each end of the "U" shaped member has attached thereto a fastening device (88, 90), and wherein the apparatus (10) further comprises a pair of mating fastening devices attached to the second section (20) and configured to be removably connected to the fastening devices (88, 90) on the "U" shaped member.

10. The apparatus according to claim 1 further comprising a hook removably attached to the second section for securing the apparatus to a closet clothes hanger pole.

11. The apparatus according to claim 1 wherein the substantially "T" shaped member (12) is fabricated from materials chosen from the group comprising silicone, silicone rubber, leather, synthetic leather, plastic, resin, denim fabric, and expanded polytetrafluoroethylene.

12. The apparatus according to claim 1 wherein the substantially "T" shaped member (12) has a degree of elasticity.

13. The apparatus according to claim 1 wherein the substantially "T" shaped member (12) is fabricated from pliable material.

14. The apparatus according to claim 1 wherein the plurality of fastening devices (40) on the front side (23) of the substantially "T" shaped member (12) and the plurality of mating fastening devices (42) on the rear side (24) of the substantially "T" shaped member (12) are chosen from the group comprising metal snaps, plastic snaps, hooks, fabric hook-and-loop fasteners, slide clasps, interlocking clasps and magnets.

15. An apparatus (10) for carrying and storing footwear comprising:

a flexible, substantially "T" shaped member (12) comprising a first section (14) that has a longitudinally extending axis (16) and which extends to a distal end (18), and a second section (20) that is transverse to the first section (14), wherein the second section (20) comprises a first portion (26) that extends in a first direction (30) to a first distal end (28) and a second portion (32) that extends in an opposite, second direction (34) to a second distal end (33), the flexible, substantially "T" shaped member (12) having a front side (23) and a rear side (24);

a plurality of fastening devices (40) on the front side (23) of the substantially "T" shaped member (12), wherein at least one fastening device (40, 40A) is located on the first section (14) adjacent to the second section (20) and at least one fastening device (40, 40B) is on the first portion (26) of the second section (20) adjacent the first distal end (28), the apparatus (10) further comprising a plurality of mating fastening devices (42) on the rear side (24) of the substantially "T" shaped member (12), wherein each of the fastening devices (40) on the front side (23) are configured to be removably attached to a corresponding mating fastening devices (42) on the rear side (24), wherein at least one of the mating fastening devices (42, 42A) is on the first section (14) adjacent the distal end (18) of the first section (14), and wherein at least one mating fastening device (42B) is on the second portion (32) of the second section (20) adjacent the second distal end (33);

wherein the first portion (26) and the second portion (32) each has a length that is sufficient to allow the first portion (26) and the second portion (32) to be inserted through an object and then attached together with the fastening device (40B) on the first portion (26) and the mating fastening device (42B) on the second portion (32) so as to form a first closed loop, and wherein first section (14) forms a second closed loop when mating fastening device (42A) is connected to fastening device (40A);

means for removably attaching a decorative item to the substantially "T" shaped member (12); and a device (80) removably attached to the substantially "T" shaped member (12) for securing the apparatus (10) to an object or structure.

* * * * *